US006058927A

United States Patent [19]

Maritan et al.

[11] Patent Number: 6,058,927

[45] Date of Patent: May 9, 2000

[54] METHOD AND DEVICE FOR ACHIEVING EASY MOVEMENT OF A COOKING HOB GAS BURNER

[75] Inventors: Marco Maritan, Viggiu'; Cesare Antonio Bocchiola, Settimo Milanese, both of Italy

[73] Assignee: Whirlpool Europe B.V., Veldhoven, Netherlands

[21] Appl. No.: 08/571,418

[22] Filed: Dec. 13, 1995

[30] Foreign Application Priority Data

Dec. 13, 1994 [IT] Italy ..... MI94A2505

[51] Int. Cl.[7] ..... F24C 3/00

[52] U.S. Cl. ..... 126/39 R; 126/39 BA; 239/203; 431/153

[58] Field of Search ..... 126/39 R, 39 H, 126/39 E, 39 A, 215, 216, 39 BA; 219/403; 239/203; 431/189, 153

[56] References Cited

U.S. PATENT DOCUMENTS

| | | | |
|---|---|---|---|
| 2,121,477 | 6/1938 | Dennis et al. | 126/39 H |
| 3,169,573 | 2/1965 | Hidaka | 126/39 R |
| 4,150,664 | 4/1979 | Trombatore | 126/299 C |

FOREIGN PATENT DOCUMENTS

| | | |
|---|---|---|
| 422 564 A3 | 4/1991 | European Pat. Off. . |
| 2 701 542 | 8/1993 | France . |
| 57-144364 | 9/1982 | Japan . |
| 1 557 641 | 12/1979 | United Kingdom . |

*Primary Examiner*—James C. Yeung
*Attorney, Agent, or Firm*—Thomas A. Schwyn; Mark A. Davis; Robert O. Rice

[57] ABSTRACT

A method for achieving movement of a gas burner of a cooking hob relative to a cavity in which said burner rests when not in use and from which it partially emerges for its activation, by which following a command for activating the burner a magnetic force is generated on the heating element which causes it to move and partially emerge from the cavity, said force ceasing when a burner deactivation command is given, with its consequent return to its rest position within the corresponding cavity. The method is implemented by a device comprising fixed conductor means arranged to cooperate magnetically with magnetically sensitive means associated with the movable burner.

12 Claims, 3 Drawing Sheets

METHOD AND DEVICE FOR ACHIEVING EASY MOVEMENT OF A COOKING HOB GAS BURNER

BACKGROUND OF THE INVENTION

1. Field of the Invention

This invention relates to a method and device to move a heating element within a cavity of a cooking hob. The heating element is within the cavity when not in use and partially emerges for activation.

2. Description of the Related Art

In the case of cooking hobs it is known to provide heating elements (such as gas burners) which are movable relative to the upper surface of said hob. Specifically, such elements or burners can assume two working positions. In a first of these positions the heating elements are retracted inside a corresponding cavity provided in the cooking hob so the top of each burner is substantially coplanar with the upper surface of the cooking hob. This makes it possible to rapidly clean said surface while at the same time provide the hob with a very attractive appearance. In the other position the burners project from the relative cavity above the cooking hob so that they can be activated and used. In the known art, the movement of each burner is achieved either by motorized mechanisms or by purely mechanical systems.

Although known cooking hobs of the type discussed above offer the attractive appearance and ease of cleaning, they have various drawbacks. In particular, they require mechanisms of high precision and reliability to ensure that after many years of use, the burners can still be moved into the two said working positions without problems. However, these high precision mechanisms are reliably attained only in an industrial production of very high cost, which is a considerable drawback.

SUMMARY OF THE INVENTION

An object of the present invention is to provide a method (and a device for its implementation) which enables reliable movement of cooking hob burners to be achieved even after many years of use. The invention provides said movement to be obtained in a simple and reliable manner by mechanisms which can be easily manufactured at low cost and in an industrial production. This and further objects, which will be apparent to an expert in the art, are attained by a method in accordance with the accompanying claims.

BRIEF DESCRIPTION OF THE DRAWINGS

The present invention will be more apparent from the accompanying drawings, which are provided by way of a non-limiting example and in which.

DESCRIPTION OF THE PREFERRED EMBODIMENT

Figure 1:
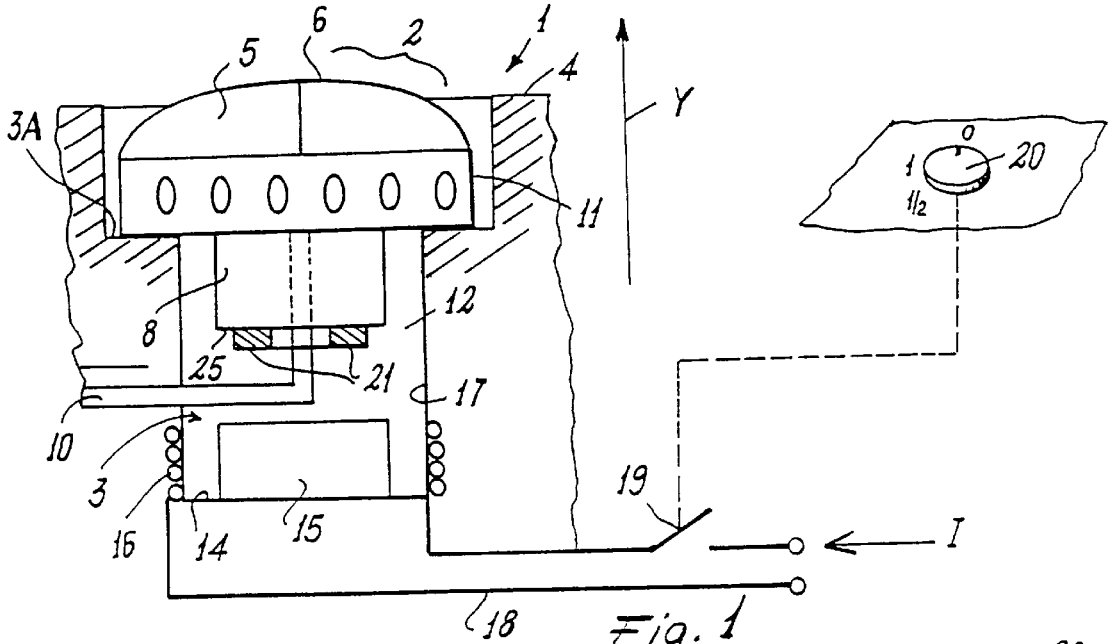
FIG. 1 is a schematic cross-section through a cooking hob portion provided with a movable burner and the device according to the invention.

With reference to said figures, a cooking hob 1 comprises at least one gas burner 2 freely movable within a corresponding seat or cavity 3 in said hob so as to be able to assume two working positions relative to the upper surface 4 of said hob. Namely a first position in which the burner is extended from the cavity 3 and projects above said surface, or another position (shown in the figures) in which the burner is retracted inside the corresponding cavity. In this latter case, the top 6 of the burner head 5 is substantially coplanar with the surface 4.

The burner 2 also comprises a body 8 with which there is associated in the usual manner, a gas feed conduit 10 of the type which allows the burner to move (for example of the partly bellows type).

According to the invention, the burner 2 can be moved within the cavity 3 by a magnetic force exerted between a fixed part associated with the cooking hob, and a part fixed to the movable burner.

Figure 2:
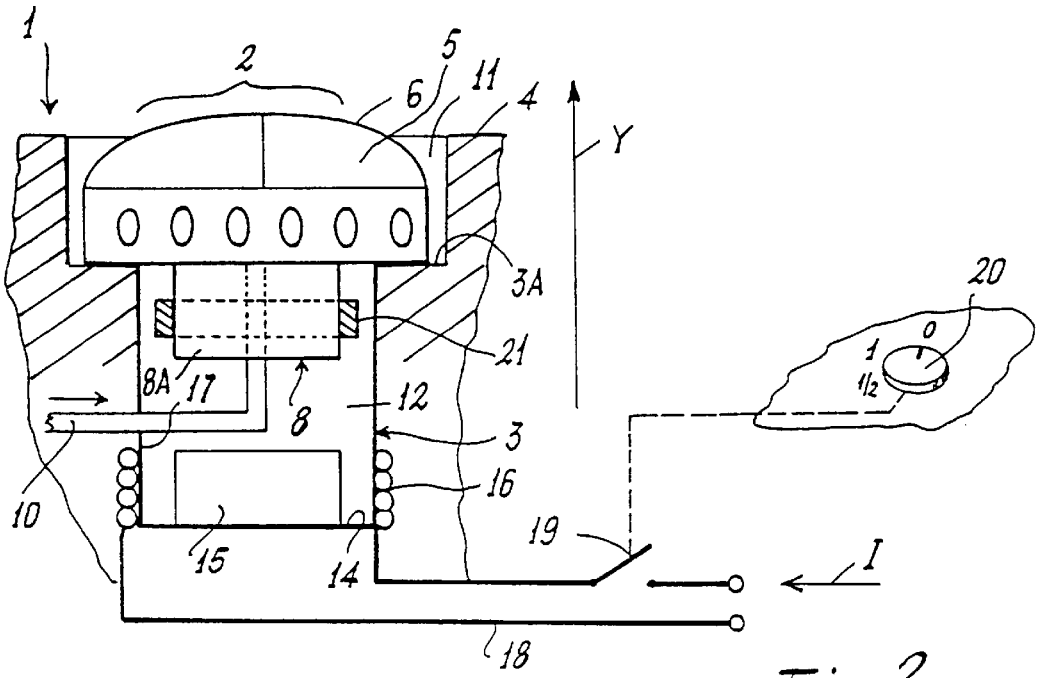
FIG. 2 is a view analogous to FIG. 1, showing a modification of the device according to the invention.

With particular reference to FIGS. 1 and 2, the cavity 3 in which the burner 2 is positioned, has an internal stepped configuration, with part 11 (the upper part in FIG. 1) close to the surface 4 being of greater diameter than the inner part 12. On the inner base 14 of said cavity 3 there is positioned a metal body 15 about which there is an electrical winding 16 associated with the wall 17 of the cavity 3. This winding is connected to a power line 18 comprising a movable switch 19 operated in the usual manner by the knob 20. Knob 20 also controls the gas feed to the burner 2. For example, the switch 19 closes following a rotary movement of the knob on activating the burner. Switch 19 closes when the knob is moved from its original "0" position, and remains in the closed state until the knob is returned to said "0" position. This is achieved by usual cam mechanisms or by activating a relay which causes the switch 19 to close.

When a current I passes through the winding, the metal body 15 is magnetized and is able to cooperate with a permanent magnet 21 that is fixed to the burner body 8. The magnet 21 can be formed either as an assembly of discrete parts or as a single annular body and is fixed to the body 8 in known manner, for example by adhesive. The permanent magnet is preferably formed from rare earth materials; however, its choice depends on the burner weight and the geometrical configuration of the burner and of the cavity 3. This configuration and the magnet 21 are chosen such that only a weak magnetic attraction exists between the magnet and the body 15 when there is no current flowing through the winding 16.

In FIG. 1 the magnet 21 is positioned on the base surface 25 of the burner body 8. In FIG. 2 the magnet is positioned annularly on the lateral wall 26 of the burner body 8. The second arrangement is used in particular to prevent the development of a strong attractive force between the magnet 21 and the burner body 15. The strong attractive force requires a strong magnetic field to be generated by the winding 16 for proper operation. The strong magnetic field requires a high current passing through winding 16 or its number of turns to be increased (with obvious drawbacks), and an increase in the power dissipated by the winding due to the Joule heating effect. Finally, the winding 16 is preferably embedded in a resin resistant to high temperature, to prevent spark generation should there be any breakage in its turns.

The cooking hob of FIGS. 1 and 2 is used as follows. When the burner is deactivated, it is in the position shown in the figures, i.e., it rests on the internal step 3A of the cavity 3. When the user operates the knob 20 to activate the burner, the switch 19 closes and a current I passes through the winding 16. This generates a repulsive electromagnetic force between the body 15/winding 16 and the magnet 21, resulting in the movement (raising) of the burner 2 (arrow Y), which is extended from the cavity 3, so that the burner 2 can be activated in known manner. The burner movement ceases when it reaches an equilibrium position in which the repulsive magnetic force equals the burner 2 weight. Limit switches could be provided (not shown) to cooperate with the burner 2 when in its extended position.

Figure 3:
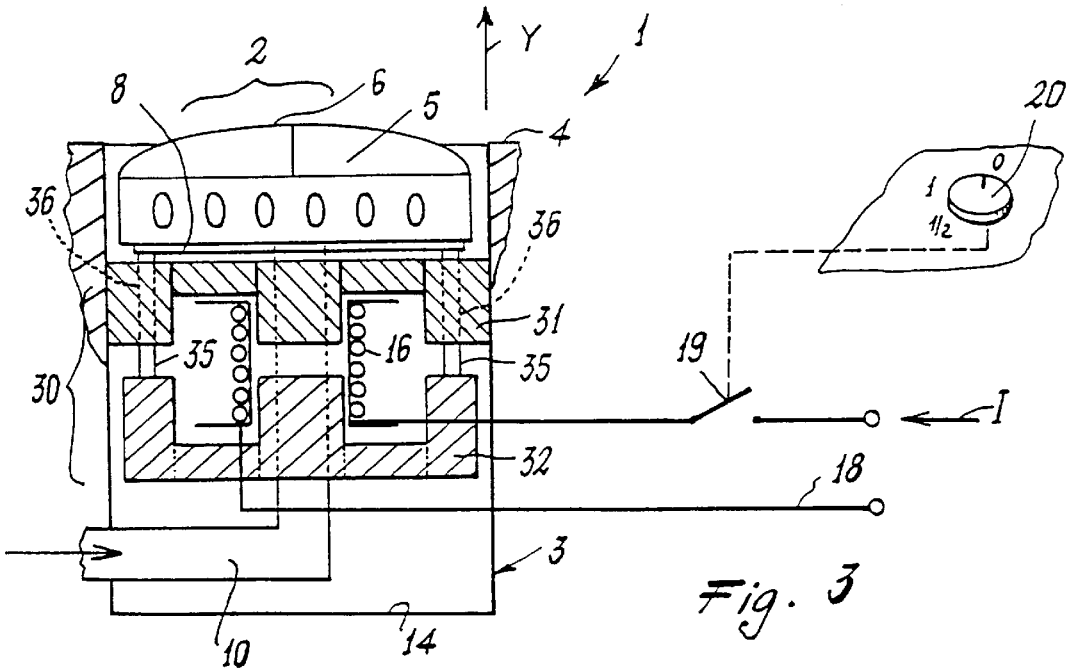
FIG. 3 is a view analogous to FIG. 1, but of a further modification of the invention.

In FIG. 3, the parts corresponding to those of the already described figures are indicated by the same reference numerals. Also, a permanent magnet is not used and instead the burner movement is achieved by an electromagnet 30 comprising the winding 16 and two magnetic cores 31 and 32 (their illustrated shape being given merely by way of example), the first core 31 being fixed to the cooking hob and positioned within the cavity 3, and the second core 32 being positioned below the first and between core 31 and the cavity base 14. Core 32 is associated with the burner body 8 by pins 35 inserted through seats 36 provided in the magnetic core 31. The winding 16 is positioned centrally within the cavity 3 and is connected to the electrical line 18. During use, when the switch 19 is closed (in the same manner as described with reference to FIGS. 1 and 2), the current I passes through the turns of the winding 16 with the result that a magnetic field is produced to attract the (movable) core 32 to the (fixed) core 31. As the burner body 8 is fixed to the movable core 32 by pins 35, the burner moves to extend from the cavity 3. The extent of travel of the burner depends on the distance between the cores 31 and 32 when the burner has retracted into the cavity 3. Also, the current intensity is chosen on the basis of the burner weight and the weight of the core 32 such as to achieve the total required movement.

Finally, the embodiment of FIG. 3 has a cost advantage over those of FIGS. 1 and 2 because it does not use permanent magnets.

Figure 4:
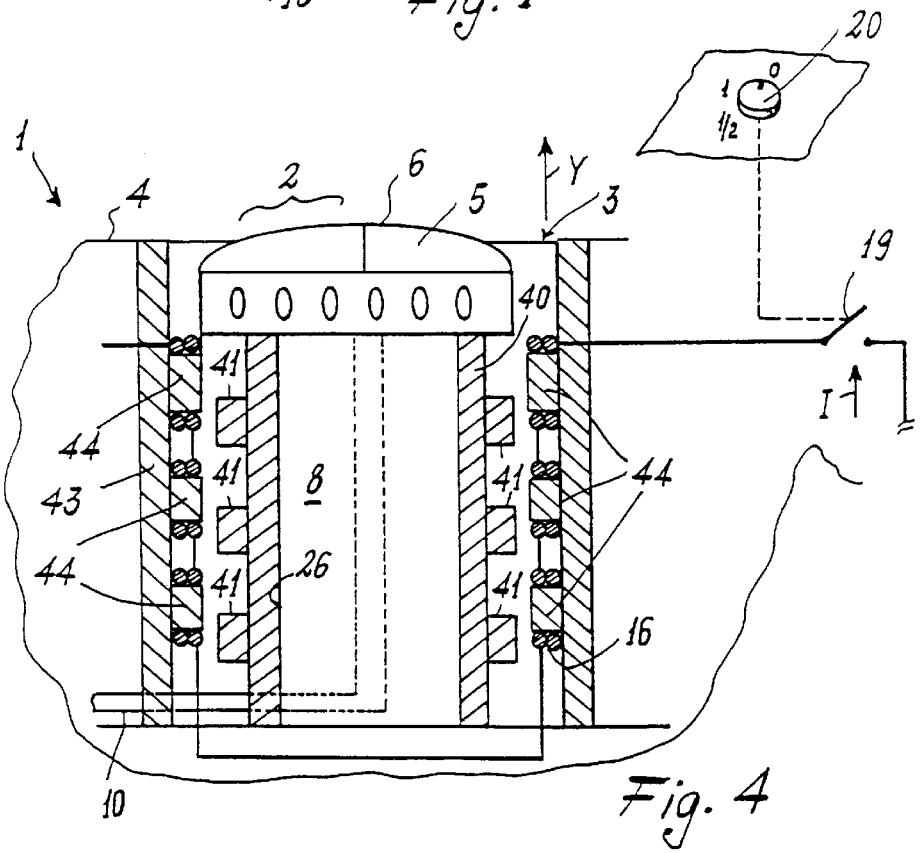
FIG. 4 is a view analogous to FIG. 1, but of a further modification of the invention.

In FIG. 4, the parts corresponding to those of the already described figures are indicated by the same reference numerals. Also, FIG. 4 shows a further embodiment of the invention. In this embodiment the burner body 8 is connected mechanically to a metal element 40 positioned on the lateral wall 26 of said body. This element 40 supports a plurality of projecting poles 41. The body 8 is positioned in the cavity 3, within the wall 17 on which there is positioned a second metal element 43 from which there project poles 44 (which when the burner has been inserted into the cavity 3 do not face the poles 41) about which the turns (connected in series) of the winding 16 are wound.

When the burner is activated, the knob 20 is operated to close the switch 19. As a result of this, current I passes through the turns of the winding 16 to generate a magnetic field which moves the body 8 until the poles 41 face the poles 44 (reducing the reluctance of the magnetic circuit). By suitably dimensioning the poles 41 and 44, different extents of travel can be achieved for the burner, and burners of different weights and geometries can be moved.

Figure 5:
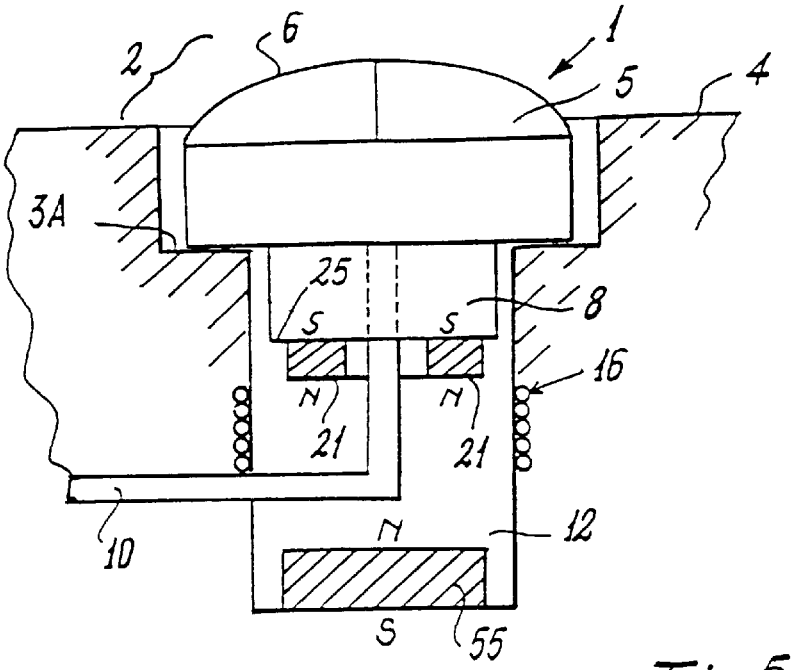
FIG. 5 is a view analogous to FIG. 1, but of a further modification of the invention.

FIG. 5 shows a further embodiment of the invention. In FIG. 5, parts corresponding to those of the already described figures are indicated by the same reference numerals. FIG. 5 shows an arrangement which is similar to that of FIG. 1, but with the difference that a permanent magnet 55 is provided (in place of the body 15 of FIG. 1) positioned on the base 14 of the cavity 3 in which the burner 2 moves. The electrical winding 16 is interposed between magnet 55 and the magnet 21 that is fixed to the burner body 8. Finally, the magnets 55 and 21 are arranged with like poles opposite each other (for example the north -N- of the magnet 55 facing the north -N- of the magnet 21).

The operating arrangement of FIG. 5 is less complex than the arrangement of FIG. 1. In this respect, when no current passes through the winding 16, the magnets 55 and 21 repel each other with a force that is less than the actual weight of the burner. Therefore, the burner remains retracted inside cavity 3 (as shown in FIG. 5). When the current I passes through the winding 16, an induced magnetic field is generated. The magnetic field generates a force, which when added to the repulsive force between the magnets 55 and 21, enables the burner 2 to move and extend from the cavity 3 so burner 2 may be used.

The arrangement of FIG. 5 enables the electrical winding to be constructed with fewer turns than that of the arrangement of FIG. 1, and to use a current (for moving the burner) of less intensity. Therefore, there is less heat dissipation within the cavity 3, resulting in less heating of those regions of the hob 1 close to cavity 3, for the arrangement of FIG. 5.

Figure 6:
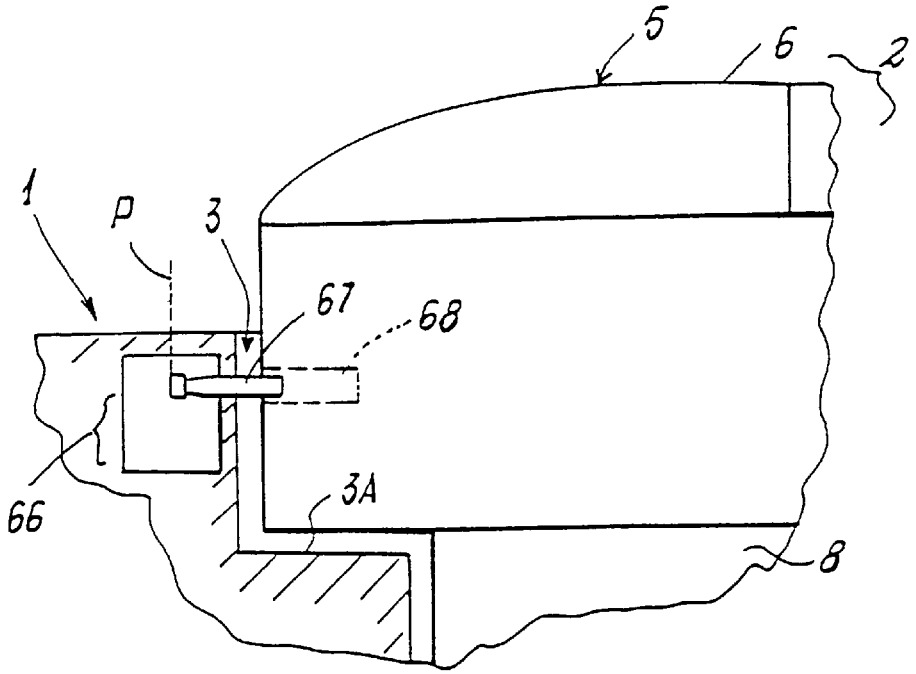
FIG. 6 is a detailed view of a further modification of the invention.

FIG. 6 shows part of a further embodiment of the invention, which can also be applied to any of the arrangements already described in relation to the other figures. In FIG. 6, the parts corresponding to those of the already described figures are indicated by the same reference numerals. FIG. 6 shows an element 66 for locking the burner 2 when it has been inserted into the cavity 3. The locking element 66 comprises a movable arm 67 arranged to cooperate with a seat 68 provided in the head 5 of the burner 2 to retain head 5 in the cavity 3. This movable arm is, for example, activated in known manner by a bistable relay with which it is associated. This relay is controlled in a known manner by the knob which controls burner operation. The arm 67 rotates about an axis P perpendicular to the hob 1 in such a manner as to be able to emerge towards the cavity 3 only when the burner head 5 is present within cavity 3 so that it becomes inserted in the seat 68 therein.

The described arrangement of FIG. 6 enables the burner 2 to be retained within cavity 3 without the necessity of passing current through winding 16 for this purpose. Obviously, two or more elements 66 can be provided about the cavity 3 to achieve optimum locking of the burner 2.

Hence summarizing, according to the invention the burner 2 can be moved:

1) by a magnetic repulsion force;
2) by a magnetic attraction force; or
3) by a magnetic force tending to reduce the magnetic reluctance between metal bodies, one fixed and one movable, and both immersed in a magnetic field generated by a current passing through turns of a winding associated with the fixed body.

The various embodiments of the invention for implementing movement by generated magnetic forces provide reliable use over time and are safe. There is also no need for precise mechanical transmission between the drive element and the burner as the burner is "suspended" by the action of the magnetic field. This simplifies the construction of a cooking hob provided with the device and allows it to be produced industrially.

Various embodiments of the invention have been described. Others are possible (for example applied to electrical heating elements of a cooking hob) and within the scope of the present invention.

We claim:

1. A method for achieving movement of a heating element of a cooking hob comprising a cavity in which the heating element rests when not in use and from which it partially emerges for its activation, the heating element being connected in known manner to a feeding conduit formed in such a manner as not to impede the heating element movement, the method comprising:

following a command for activating the heating element, a magnetic force is generated on the heating element which causes the heating element to move and partially emerge from the cavity, said force ceasing when a heating element deactivation command is given, with a consequent return of the heating element to its rest position within the corresponding cavity.

2. A method as claimed in claim 1, wherein the magnetic force acting on the heating element is a repulsive type.

3. A method as claimed in claim 1, wherein the magnetic force acting on the heating element is an attractive type.

4. A method as claimed in claim 1, wherein the magnetic force acting on the heating element is of the type tending to reduce the magnetic reluctance between parts associated with said element and fixed parts immersed in a magnetic field.

5. A method as claimed in claim 1, wherein the magnetic force is generated by causing an electrical signal to flow within a conductor positioned within the cavity in which the heating element is at least partly contained.

6. A method as claimed in claim 1, wherein halting of the heating element in a position partly projecting from the corresponding cavity is achieved by balancing the magnetic force with the actual weight of the heating element.

7. A device for achieving movement of a heating element of a cooking hob, comprising:

at least one heating element, that is movable relative to a corresponding cavity which contains the heating element;

the heating element is movable between a first working position and a second working position, the heating element partly projects from the cavity when in the second working position, said device further comprising conductor means which receive an electrical signal following a heating element activation command by the user, said conductor means being fixed and cooperating magnetically with a magnetically sensitive means associated with the movable heating element, the presence of said electrical signal in said conductor means causing said element to move into the corresponding cavity and to emerge therefrom.

8. A device as claimed in claim 7, wherein the conductor means cooperate with at least one fixed metal body and comprise an electrical winding connected to an electrical feed line in which there is a switch that is closed by a usual member for activating the heating element.

9. A device as claimed in claim 7, wherein the magnetically sensitive means are a permanent magnet associated with the body of the heating element.

10. A device as claimed in claim 9, wherein the permanent magnet is positioned annularly on the lateral wall of the body of the heating element.

11. A device as claimed in claim 7, wherein the magnetically sensitive means are a metal body positioned within the cavity between the fixed metal body and the cavity base, said metal body being associated with the heating element body by pins slidable within through seats provided in the fixed metal body.

12. A device as claimed in claim 7, wherein the magnetically sensitive means are a plurality of poles projecting from the lateral surfaces of the heating element body and arranged to cooperate magnetically with poles projecting from the wall of the cavity within which the heating element moves.

* * * * *